US005304759A

United States Patent [19]

Doherty

[11] Patent Number: 5,304,759

[45] Date of Patent: Apr. 19, 1994

[54] DIRECT MOUNT PRESSURE CONTROL WITH A FIELD ADJUSTABLE TRIP POINT AND RESET POINT

[75] Inventor: Robert Doherty, New Hudson, Mich.

[73] Assignee: Johnson Service Company, Milwaukee, Wis.

[21] Appl. No.: 969,861

[22] Filed: Oct. 15, 1992

[51] Int. Cl.[5] ..... H01H 35/40

[52] U.S. Cl. ..... 200/83 SA; 200/835

[58] Field of Search ..... 200/82 A, 83 R, 83 J, 200/83 S, 83 SA

[56] References Cited

U.S. PATENT DOCUMENTS

| | | | |
|---|---|---|---|
| 2,291,554 | 7/1942 | Muchow | 200/83 |
| 2,789,173 | 4/1957 | Kaminky | 200/67 |
| 3,194,916 | 3/1962 | Vischer, Jr. | 200/83 |
| 3,233,055 | 2/1966 | Russell | 200/67 |
| 5,120,915 | 6/1992 | Doherty | 200/83 J |

*Primary Examiner*—A. D. Pellinen
*Assistant Examiner*—Michael A. Friedhofer
*Attorney, Agent, or Firm*—Foley & Lardner

[57] ABSTRACT

A pressure control for use in applications such as refrigeration, air conditioning and ice generating machinery includes a highly accurate snap acting switch, field adjustable trip points and reset points and a reference scale. The trip point is adjusted by means of an adjustment screw, while the reset point is adjusted by changing the differential, or the difference between the trip point and reset point. The differential is adjusted by adjusting the amount of "lost motion" within the control by employing an actuator which includes a cam surface and means for changing the position of the cam surface.

19 Claims, 4 Drawing Sheets

DIRECT MOUNT PRESSURE CONTROL WITH A FIELD ADJUSTABLE TRIP POINT AND RESET POINT

BACKGROUND OF THE INVENTION

1. Field of the Invention

The present invention relates generally to the field of pressure controls and, more particularly, to the field of compact, direct mount pressure controls for use on machinery such as that used for refrigeration, air conditioning and ice generation. Still more particularly, the invention relates to a positive action switch, wherein the switch is thrown to a first position when an actuator is moved to a first position and is returned to its initial position when the actuating plunger moves to a second position different from the first position. Still more specifically, the present invention relates to adjustment of the set and return points, including simplified control of the lost motion aspect of the invention.

2. Description of the Prior Art

On refrigeration, air conditioning and ice generation equipment, a variety of pressure controls have been used in the past to cycle the compressor, cycle the condenser fan, prevent system overload, etc. In the past, these controls have generally fallen into two categories. In the first, highly accurate controls which had easily accessible trip points and reset points were used and were adapted to various applications and field conditions. These controls normally relied on extensive lever mechanisms and multiple springs to make adjustments. These components made them unsuitable for mounting directly to the equipment due to the high vibration levels usually associated with such equipment. This necessitated mounting the control remotely from the equipment and connecting the control with a hose or capillary. Breakage or leakage in the hose or capillary would result in a loss of refrigerant charge.

The second type of prior art controls have been direct mount controls, which were usually constructed in a rugged manner to take the compressor vibration. However, these controls were usually less accurate than the type described above. The majority of the direct mount controls have trip points and reset points which are factory set and are not field adjustable. Even on those controls where field adjustment is possible, it has been very difficult and usually requires that the control be removed from the equipment to make the adjustment. Also, in the latter case, it has been a typical practice to adjust the differential by varying the contact gap, which in turn severely limits the load which the switch can effectively carry.

One type of control which has been employed is the positive action switch or snap switch. Generally speaking, it consists of a flexible arm which is contacted by an actuating plunger to force the flexible arm past an "over center position." As soon as the flexible arm is forced past such position, the construction of the switch is such that the portion of the arm carrying electrical contacts will move from positive contact with a stationary contact on one side to contact with a stationary contact on its other side by a single positive movement known commonly as the "snap." See, for example, U.S. Pat. No. 2,789,173, issued Apr. 16, 1957.

When the plunger is retracted away from the flexible arm in such devices, the flexible arm again passes over its over center position, which causes the flexible arm to "snap" the contacts carried by it back to their first position. Thus, a basic characteristic of these devices was that the switching action will occur at substantially the same position of the plunger, regardless of whether the plunger is traveling in one direction or the other, for there is only a very small distance of a few thousandths of an inch between each side of the over center position. Previously, deficiencies noted for such switches were overcome by utilizing more than one positive action switch whenever it was desirable to have switching in a circuit occur at different positions of the device which actuates the switch plunger.

In U.S. Pat. No. 3,233,055, issued Feb. 1, 1966, a switch was described which overcame the latter problem by providing means in a single positive action switch for differential switching positions of the actuating plunger. Furthermore, in the device shown in this patent, the distance of actuating plunger travel between switch operation in one direction and switch operation in the opposite direction was adjustable, utilizing the positioning of two "abutments" in different areas of the switch to engage opposite sides of the switch blade, depending on which direction the plunger was traveling. Movement of the plunger was opposed by a resilient device such as a spring, so that when the plunger was retracted, the switching operation in the opposite direction would occur only when an abutment carried between the spring and the switch arm reached the surface of the switch arm, resulting in a lost motion approach to switch adjustment. In such device, instead of only a few thousandths of an inch existing between switch operation and switch reactivation, switching in the opposite direction would not occur until the plunger has been withdrawn to a position on the order of thirty thousandths to one hundred fifty thousandths (30/1000-150/1000) of an inch further away from the position which would normally cause the switch to operate. The device provided means not only for adjusting the initial switch point, but also the distance between the differential positionings of the actuating plunger.

During operation of the switch most recently referred to, actuation of the plunger would cause contact on the upper surface of the switch blade, forcing it down until the blade would snap to the depressed position. The free end of the blade would bring the contacts from one location to another, resulting in the desired switch actuation. Following switching, typically the passive plunger, located on the opposite side of the switch blade, would start to move but would not cause the switch to move to its initial position until it had moved upwardly by approximately one hundred thousandths (100/1000) of an inch. An abutment on the passive plunger would, at that point, approach the lower side of the blade, eventually contacting it and providing the force to bulge the blade upwardly and snap it to its elevated, original position. The differential distance between the actuation positions was adjusted by rotating threaded plugs with a screwdriver, such adjustment varying the amount of protrusion of a pin beyond the abutments and therefore controlling the distance between the respective abutments described in the patent.

With the device described in the last-mentioned patent, control has been a problem, as has been the establishment of the relative pressures set by the various adjustment mechanisms.

A pressure switch which overcomes the disadvantages of the prior art would be a significant advancement in the art.

SUMMARY OF THE INVENTION

The present invention features a switch which can be direct mounted to equipment and which is durable in construction. The switch of the present invention further features the ability to set, in the field, the initial trip point, as well as the reset point. The present invention also features a switch which includes a scale for noting the settings which are made and a novel system for adjusting the reset point using a rotatable actuator which includes a cam surface to adjust the "lost motion" of a reset spring. Further the present invention features a unique main spring and switch blade assembly which allows several of the previously mentioned features to be accomplished.

How these and other features of the invention are accomplished will be described in the following specification taken in conjunction with the FIGURES. Generally, however, in the most preferred form of the invention they are accomplished in a pressure control switch which includes a housing, preferably one made from the new class of engineering plastics, so that the major housing components can be sealed, e.g. by the process of ultrasonic welding. One face of the housing includes the electrical leads from the controls within, adjustment screws for both the trip point and the reset point and a transparent window for observing a scale mounted within the housing. The other face includes a coupling to the source of the pressure to be sensed.

Within the housing, a diaphragm is provided along with a main spring and control plunger. The latter is arranged to interact with an actuator element which is generally disk-like and has opposing faces. The plunger contacts a first face, while the other face is adapted to contact a blade. Moreover, the actuator is rotatable by means of a gear arrangement and set screw so that a cam surface arranged on the second face is movable with respect to a portion of a reset spring which passes through the blade and provides "lost motion". The reset point can be set at a different value than the trip point. The blade includes a pair of contacts on opposite sides and a set point adjustment screw interacts with the main spring to establish the trip point and to rotate the scale to provide a visual indication of the trip point.

Other ways in which features of this invention are provided will become apparent to those skilled in the art after the present specification is reviewed. Such other ways are deemed to fall within the scope of the invention.

DESCRIPTION OF THE DRAWINGS

In the various FIGURES, like reference numerals are used to show like components.

DETAILED DESCRIPTION OF THE PREFERRED EMBODIMENT

Figure 1:
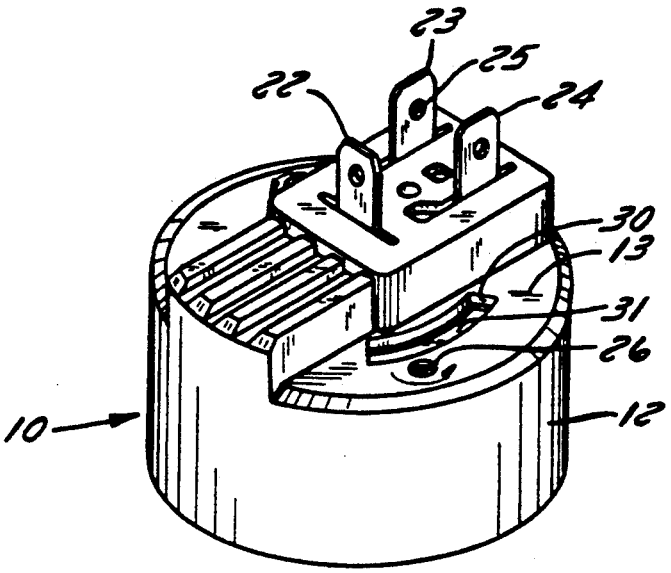
FIG. 1 is a perspective view of the pressure control switch of the preferred embodiment of the present invention.

Before proceeding to the description of the preferred and illustrated embodiment, several comments would be appropriate regarding the invention illustrated thereby. For example, while certain materials are preferred and are described in the remainder of the specification, a wide variety of alternate materials can be used for various components. Furthermore, the relative sizing of components could vary widely, as the illustrated control was designed for a particular application. Moreover, while the scale shown and described later in this section is desirable, it is not essential to the operation of the broadest embodiment of the present invention.

Referring first to FIGS. 1-3B, a pressure control switch 10 according to the preferred embodiment of the present invention is shown in perspective, top and sectional views. The overall appearance and operation of switch 10 will be discussed first as a prologue to a more detailed description of the internal components. The latter are best understood by reference to the sectional views 3, 3A and 3B and the two exploded assembly drawings, FIGS. 4-5.

Switch 10 includes a generally cylindrical housing 12 and a bottom closure 14. The housing 12 includes a circular top 13 and has a side wall 16. Housing 12 and bottom 14 are preferably molded plastic, for example engineering thermoplastics of the type which may be sealed together, such as by the process of ultrasonic welding. Adhesives can be used for such sealing, but it is believed that ultrasonic welding provides a more rugged enclosure for controls of the direct mount type.

Bottom 14 includes a centrally located opening 17 extending through a threaded, generally cylindrical extension 19, permitting coupling of switch 10 to a device, the pressure of which is to be controlled. For purposes of explanation, such device could be of the refrigeration, air-conditioning or ice generation type with the control being used to cycle a compressor, condenser fan, or the like.

Extending through top 13 are three terminals 22-24, as is known for this type of control. They include a common terminal 22, a normally closed terminal 23, and a normally open terminal 24. Each may include a hole 25, if desired. The top view of FIG. 2 also shows the location of two set screws 26-27, set screw 26 being used to establish the trip point of switch 10 and set screw 27 being used for establishing the differential, i.e. the pressure at which the switch will automatically reset to its initial position.

Figure 2:
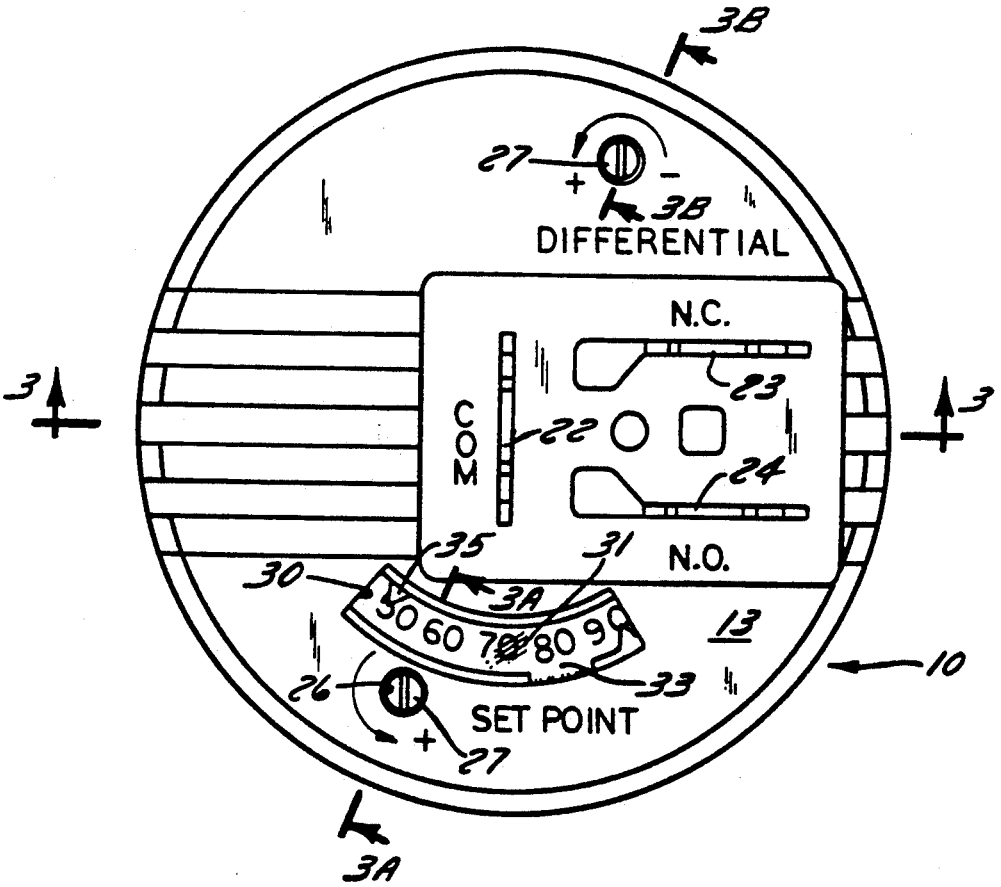
FIG. 2 is a top elevation view of the switch shown in FIG. 1.

Also evident from FIGS. 1-2 is a window opening 30, sealed by a window 31 (shown in FIGS. 4 and 5) to permit viewing of a scale 33 located therebeneath. A scale indicator 35 mounted rigidly in switch 10 is arranged to indicate the trip point pressure, and as will be more fully described later, scale 33 will rotate as the set screw 26 is moved. Directional indicators may be provided on face 13 to show how movement of the set screws 26-27 will alter the pressures. In addition, the numbers on the scale are for illustration and can vary widely depending on the end use application of, switch 10.

Figure 3:
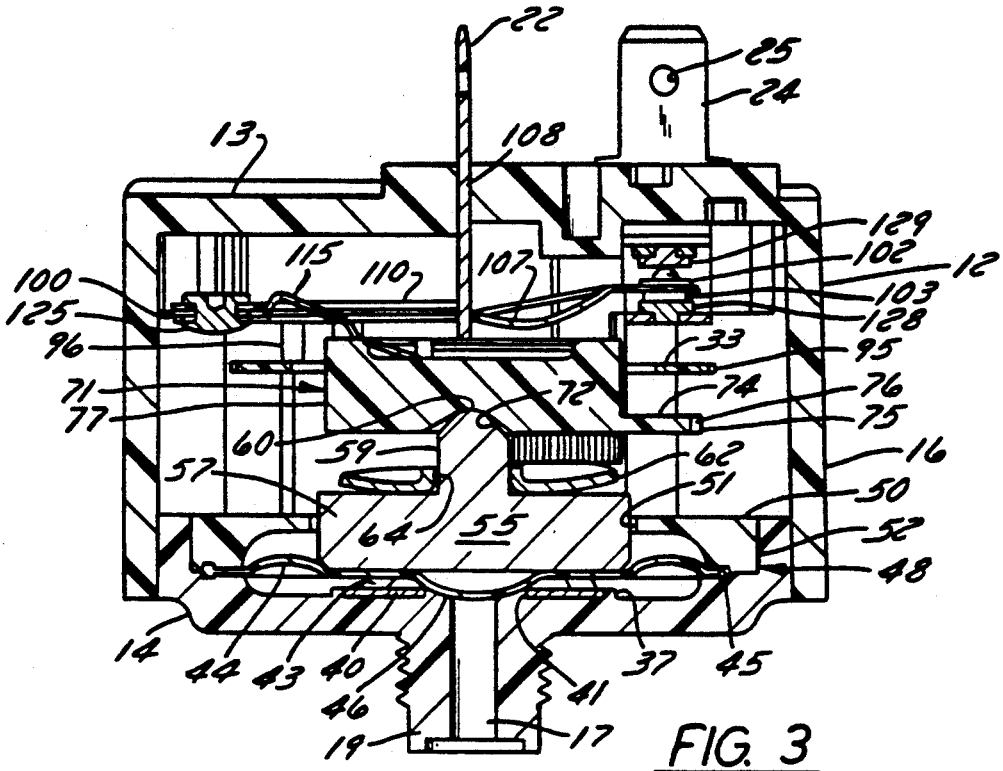
FIG. 3 is a sectional view taken along the lines 3—3 of FIG. 2.
Figure 3A:
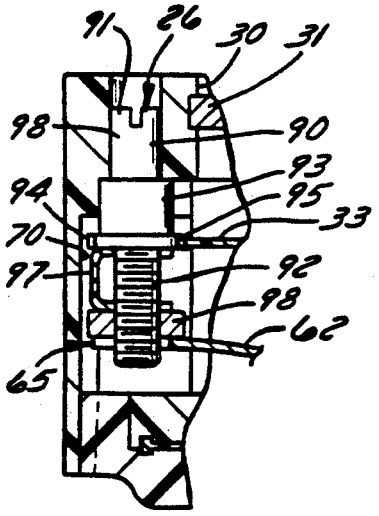
FIG. 3A is a sectional view taken along the lines 3A—3A of FIG. 2.
Figure 3B:
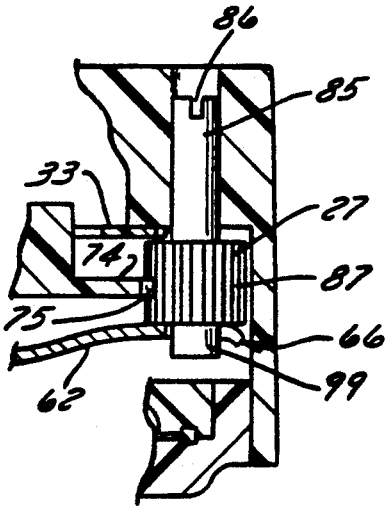
FIG. 3B is a sectional view taken along the lines 3B—3B of FIG. 2.
Figure 4:
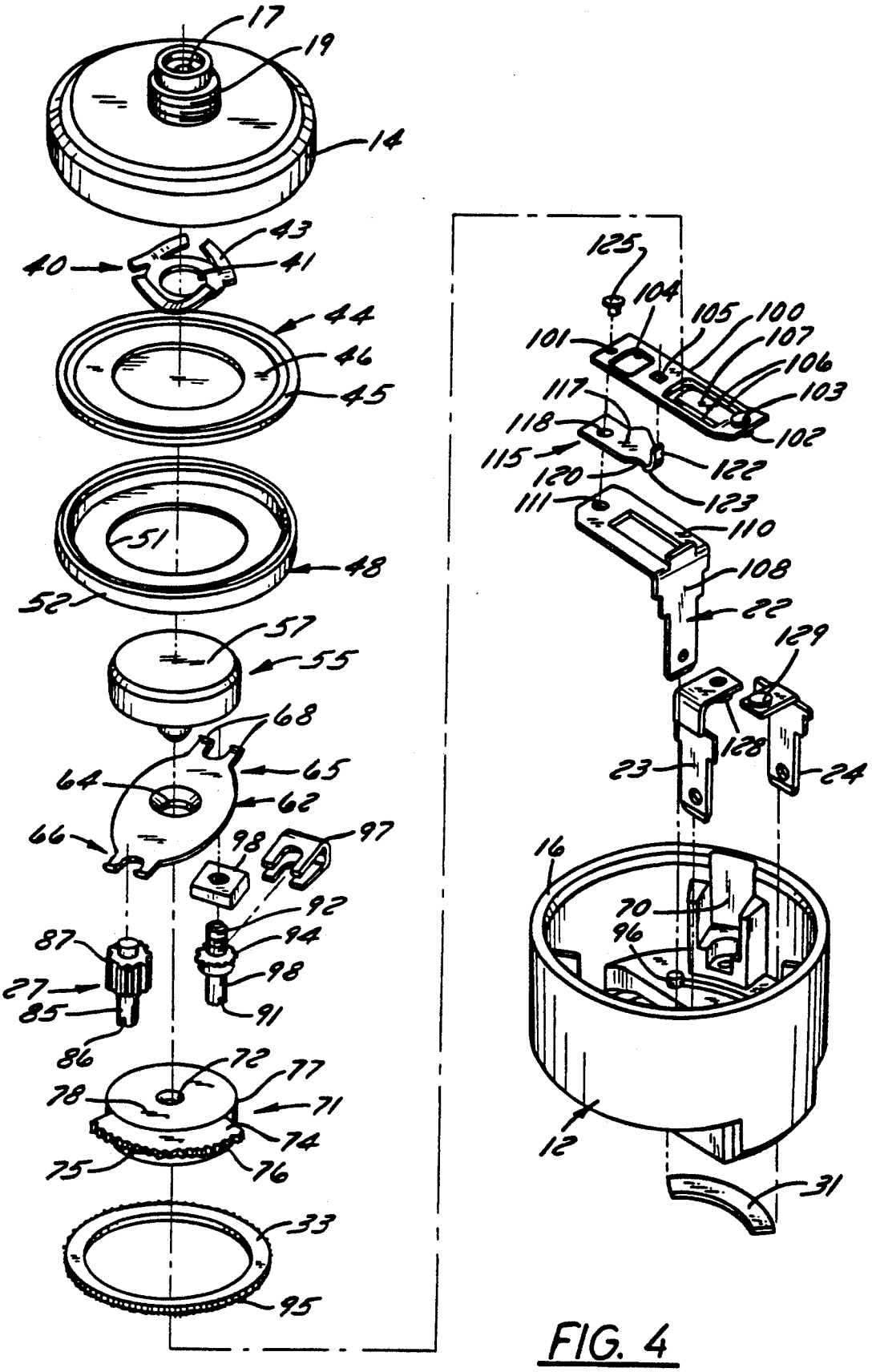
FIG. 4 is a first exploded assembly view of the switch shown in the previous FIGURES.
Figure 5:
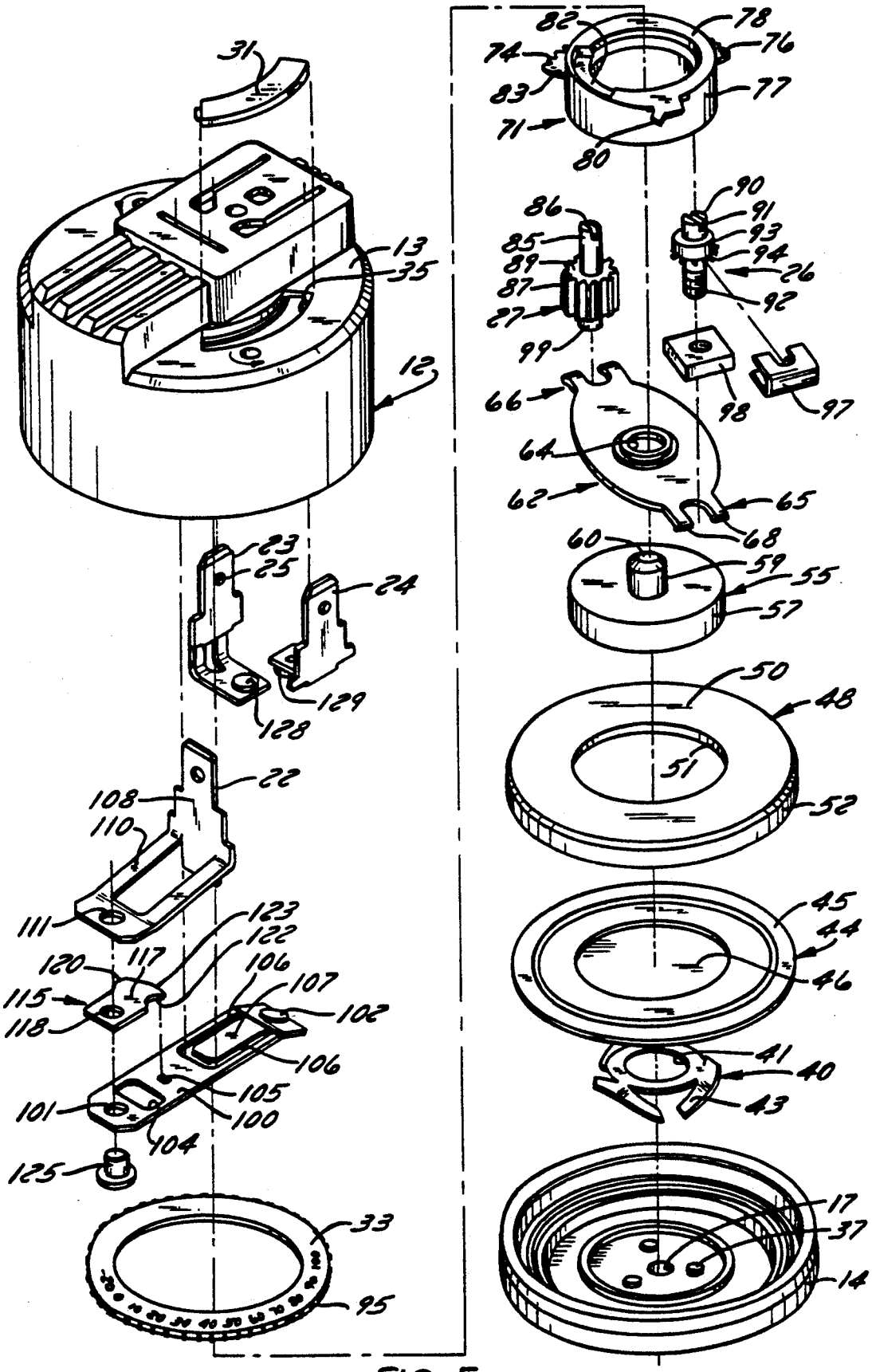
FIG. 5 is a second exploded assembly view of the switch shown in the previous FIGURES, but showing the opposite sides of some of the components.

Referring next to FIGS. 3-5, further components of switch 10 will be explained along with their orientation within housing 12. Proceeding from the lower part of switch 10, bottom 14 includes three down stops 37 on its inner surface located about opening 17 and spaced at 120° intervals. A surronding ring 38 centers and retains a vacuum offset spring 40 which includes a central aperture 41 and three leaf spring elements 43 which provide resiliency and support for subsequently described elements in the event a negative pressure is experienced at opening 17.

The next component of switch 10 is a diaphragm 44 which, in the preferred embodiment, is a thin, resilient, circular, single convolution element made from a material such as a polyimide resin. It includes an outer edge 45, and a central circular portion 46. A diaphragm cover 48 holds diaphragm 44 against bottom 14 and includes a circular top 50 having a central opening 51 and a depending side wall 52. The opening 51 is larger than center 46 of the diaphragm 44, the reason for which will soon become apparent.

The cover 48, bottom 14 and housing 12 are preferably sealed to one another by ultrasonic welding, whereby diaphragm 44 is secured in place about its circumference through the pressure of side wall 52 against edge 45. The diaphragm 44 is spring loaded upwardly by spring 40, and opening 17, opening 41 (of spring 40), center portion 46 (of diaphragm 44) and opening 51 (of cover 48) are coaxial.

Switch 10 next includes a plunger 55 which consists of a disc 57 and a point 59, the latter extending centrally from the upper face of disc 57, and terminating in a frusto-conical tip 60. The disc 57 is sized to slidingly fit through opening 51 in cover 48 so that its planar lower surface will fit over center 46 of diaphragm 44. As will become more fully understood hereafter, tip 60 will be received in a receptacle of the switch actuator which will, in turn, contact and move the switch blade.

Plunger 55 is biased against the diaphragm 44 by a main switch spring 62. This element is generally ellipsoidal in shape, has a central opening 64 large enough to receive point 59 therethrough and first and second ends 65-66. The ends 65-66 are forked and each includes two prongs 68. Spring 62 has a total length just slightly less than the internal diameter of housing 12 and is captured within housing 12 by two channels 70 (see FIG. 4) which run vertically down opposite sides of housing 12 in the area generally beneath the aforementioned set screws 26 and 27. Channels 70 also serve important functions regarding the actuator adjustment and set point alteration, as will later be described in greater detail.

The actuator for the switch blade of switch 10 is shown at 71 in the FIGURES and includes several important features. Actuator 71 is generally disc-like in configuration and includes a central recess 72 in its lower surface adapted to receive tip 60 of the plunger 55. Also, extending from the lower surface is an arcuate flange 74 describing an arc of about 120°, the outer edge 75 of which includes teeth 76. The distance from the center of recess 72 to edge 75 is greater than the distance from the center of recess 72 to the generally cylindrical side wall 77 of actuator 71. The top surface 78 of actuator 71 includes an outwardly directed indicator 80 located approximately 180° from the center of edge 75 (but on the other surface of the actuator). Indicator 80 is adapted to point to an indicia on scale 33, indicating the differential pressure established by set screw 27. Top surface 78 also includes an elongate, arcuate cam surface 82 extending about a portion of its circumference, generally in the area between indicator 80 and one end 83 of flange 74. Cam surface 82 tapers from top surface 78 down into the body of actuator 71 by 0.064 inches or more (the length not being critical). The purpose of the cam surface will also become apparent shortly.

Adjustment screw 27 can now be described in greater detail and includes a cylindrical rod 85 having a slot 86 in one end to receive a screw driver or other device for turning the screw. At its opposite end, screw 27 includes a gear 87 surrounding rod 85, the gear 87 being sized to interact with the teeth 76 of flange 74 on actuator 71 to cause rotation thereof about its axis. Screw 27 fits within one of the channels 70 in housing 12 and holds scale 33 in place through contact of upper surface 89 of gear 87. It will be appreciated then that rotation of set screw 27 will cause rotation of the cam surface 82 and indicator 80 but will not cause any rotation of scale 33.

Adjustment screw 26 is located within the opposite channel 70 and also includes a rod 90 having a slot 91 adapted to receive a screw driver or other adjustment device. The opposite end of rod 90 is threaded at 92 and a disc like ring 93 is formed in rod 90 intermediate its ends. Located immediately below the ring 93 (on the side opposite slot 91) is a circular gear 94, this gear adapted to intermesh with the teeth 95 surrounding scale 33.

Scale 33 fits within housing 12 on four posts 96 spaced around the interior of housing 12, one of which is visible in FIG. 4. The posts 96, as well as the two set screws, maintain the scale in a position, oriented below window 31. A spring clip 97 also fits around the threaded portion 92 of screw 26 and a nut 98 is threaded over the end thereof. In this arrangement, the nut 98 may be used for the important function of controlling the pressure exerted by main spring 62 on plunger 55. Nut 98 is sized to be slidingly received in a channel 70 but it is not free to rotate therewithin. With the prongs 68 of main spring 62 being received in the channels, end 66 will be unaffected by rotation of set screw 27 since the lowest portion 99 of rod 85 fits between the prongs. On the other side, however, rotation of set screw 26 will cause vertical movement of nut 98 which rests against the prongs 68 of end 65 and accordingly, will cause movement of the spring. The pressure against the actuator 71 will accordingly be adjusted and indicated on scale 33, since the latter will be simultaneously rotated by the interaction of gear 94 and teeth 95. Spring clip 97 maintains pressure between gear 93 and nut 98 during such rotation of screw 26.

The next components of switch 10 to be described are the switch blade 100, a reset spring 115 and their arrangement relative to terminals 22-24. Blade 100 is elongate and includes a hole 101 at a first end. A pair of electrical contacts 102-103 at its opposite end. The end of blade 100 which contains the contacts 102-103 is bent downwardly slightly as shown in the FIGURES.

A generally rectangular opening 104 is provided in blade 100 near hole 101 and adjacent to but spaced apart from hole 104, and nearer still to the contacts 102-103, is a smaller opening 105. Blade 100 also includes a U-shaped slot 106 between hole 105 and contacts 102-103 defining a generally rectangular section 107, all arranged to provide the desired amount of spring bias when blade 100 is rigidly secured to housing 12.

Terminal 22 can be best seen in FIGS. 4–5 and is generally L-shaped having an upstanding portion 108 which extends through the top face 13 of housing 12 (and the bottom of which extends down through slot 106 of blade 100) and a perpendicular section 110 which also includes a hole 111 arranged to overlap hole 101 of blade 100.

Located between terminal 22 and blade 100 is a reset spring 115. Spring 115 includes a first generally planar portion 117 having a hole 118 therein. Portion 117 also has a reduced width and bent section 120 which terminates in a downwardly directed point 122 having a shoulder 123 therein spaced apart from its tip.

The assembly of blade 100, reset spring 115 and terminal 22 is accomplished with a rivet 125, it being appreciated from the exploded drawings that portion 120 fits within an opening 127 of area 110 of terminal 22 and that point 122 will extend downwardly through the hole 105 of blade 100. The spring 115 will thus be held in such a manner that the bias of point 122 is downwardly, but it should also be noted that point 122 is sized to slide freely within hole 105. When so affixed, blade 100 will also be biased downwardly. For reference, "downwardly" means toward bottom 14, rather than with respect to any particular orientation while in use.

Before proceeding to the description of how spring 115 and actuator 71 interact, reference should be had in FIGS. 4–5 to see the preferred arrangement of terminals 23–24. Each is generally L-shaped and include a terminal contact 128–129 respectively. They are mounted within housing 12 so that contact 103 of blade 100 will normally be biased against contact 128 of terminal 23. When upward pressure is exerted on blade 100, the blade will snap upwardly so that contact 102 will then engage contact 129 on terminal 24. The operations which take place when such switching occurs is well-known from other such switches (such as the '173 patent previously discussed) and will not be described in further detail herein.

Now that all the components of switch 10 have been described, its operation can be more fully understood. It is triggered by pressure at opening 17 exerting forces on the diaphragm 44, causing it to move upwardly and in turn causing plunger 55 and actuator 71 to move upwardly. Depending upon the spring forces exerted by main spring 62, which in turn is adjustable using set screw 26, the forces may be sufficient to cause blade 100 to snap, energizing the "normally off" circuit to conduct an operation, e.g. shutting off a refrigeration compressor. The pressure set by adjustment of set screw 26 will be readily ascertainable from the scale 33 as noted by indicator 35.

The reset point, i.e. the change in pressure required to reset blade 100 to close the "normally on" circuit is adjustable by screw 27. By the previously described interaction of screw 27 and actuator 71, it should be appreciated that actuator 71 will rotate about its axis, moving indicator 80 as well so that the adjusted reset pressure will be apparent from scale 33. More importantly, the location of the cam surface 82 will be adjusted upon such rotation, changing the depth of that surface with respect to the point 122 of reset spring 115. At one extreme, point 122 will be residing in the lowermost part of cam surface 82 so that shoulder 123 will be at or very near the surface of blade 100. In this orientation, when the pressure at opening 17 is sufficient to snap blade 100, a minimal reduction in pressure will quickly cause blade 100 to return to its normal position. On the other hand, when actuator 71 is rotated so that tip 122 is located at the upper part of cam surface 82, near or at the face of actuator 71, a larger reduction in pressure will be necessary to reset blade 100 due to lost motion as the point 122 slides through hole 105 until shoulder 123 contacts blade 100 and returns it to its original position. The amount of such lost motion can be varied by set screw 27, between the extremes just described. For each such pressure, indicator 80 will provide a visual indication of the selected reset point.

While spring 115 has been described in the description of the preferred and illustrated embodiment, other devices which penetrate hole 105 and which are resiliently biased against cam surface 82 could be substituted therefor. An example of such a substitution would be to locate a spring-loaded rod having an abutment in housing 12 so that the end of the rod penetrates hole 105. The distance between the abutment and the tip of the rod would define the range of lost motion available for such a device. Rotation of actuator 71 would determine the reset point as discussed above.

While the present invention has been described in connection with a preferred embodiment, reference is again made to the introductory remarks for this section of the specification with respect to the variables of material and arrangement of which may be practiced once the principles of the invention have been read and understood. Accordingly, the present invention is not to be limited by the description of the FIGURES, but is to be limited solely by the scope of the claims which follow.

What is claimed is:

1. A pressure switch comprising:
- a body having an opening communicating with the pressure to be sensed;
- a blade within the body being normally biased to a first position;
- an actuator within the body for moving the blade from its first to a second position when the sensed pressure exceeds a first preselected level;
- means for changing the first preselected level;
- means for returning the blade to its first position from the second position when the sensed pressure falls below a second preset level;
- a cam surface on the actuator, the returning means contacting the cam surface; and
- means for moving the cam surface for changing the second preselected level.

2. The switch of claim 1 wherein the returning means comprises a spring, the blade includes a hole and the return spring includes a point passing through the hole and contacting the cam surface.

3. The switch of claim 1 wherein the actuator is generally circular, disk-shaped and the cam surface is an arcuate cam surface on a face of the actuator and wherein the switch includes means for rotating the actuator to change the position of the cam surface.

4. The switch of claim 1 further comprising an indicator scale within the body and viewable from the exterior thereof.

5. The switch of claim 1 further including a main spring acting on the actuator and wherein the means for charging the first preselected level comprises means for changing the pressure of the main spring against the actuator.

6. The switch of claim 4 wherein the switch includes means for moving the scale as changes are made in the first preselected level and an indicator on the body for indicating the first preselected level.

7. The switch of claim 3 wherein the actuator includes a pointer and the switch further includes an indicator scale, whereby rotation of the actuator will provide a visual indication of the second preselected level.

8. The switch of claim 1 wherein the body further includes a diaphragm adjacent the opening, a plunger contacting the diaphragm and movable in response to changes in the sensed pressure, the plunger also contacting the actuator and a main spring biasing the actuator away from the blade.

9. The switch of claim 1 further comprising set screws for changing each of the first and second preselected levels.

10. The switch of claim 1 wherein the returning means comprises an elongate element extending through the blade and having an abutment thereon, the element contacting the actuator on the opposite side of the blade from the abutment, whereby varying amounts of lost motion are provided in the switch depending on the position of the cam surface with respect to the element.

11. The switch of claim 1 further including a pair of contacts on the blade and a terminal pair arranged with respect to the contacts so that one contact abuts one terminal when the blade is in its first position and the other contact abuts the second terminal when the blade is in its second position.

12. A pressure switch having a cylindrical housing and an opening to the pressure to be sensed, a resilient diaphragm adjacent the opening, an actuator movable in response to the sensed pressure, an elongate switch blade with a first end normally biased to a first position, the first end having contacts on opposed sides, the blade being movable to a second position when the actuator moves in response to a sensed pressure above a first predetermined level, terminals for contacting one of the blade contacts when the blade is in each of its first and second positions, and a main spring in the body, the switch further comprising:

means for varying the pressure of the main spring against the diaphragm;

a blade return spring having a sliding portion passing through the blade and biased for contacting the actuator, and an abutment on the portion;

cam means on the actuator for receiving an end of the portion of the blade return spring and for varying the penetration of the portion and the abutment dependent upon the position of the cam surface; and means for moving the cam surface to adjust the relationship of the portion end along the cam surface.

13. The switch of claim 12 wherein the actuator is a generally cylindrical disk adapted to be rotated about an axis which is coaxial with the axis of the housing, the actuator including the cam surface arranged in an arc on a face thereof and the moving means includes means for rotating the disk.

14. The switch of claim 13 wherein the actuator includes teeth about its circumference and the moving means includes a rotatable set screw having a gear engageable with the teeth of the actuator.

15. The switch of claim 12 further including a set screw with a threaded portion arranged to interact with a nut slidingly contained within the housing, the nut contacting the main spring.

16. The switch of claim 15 wherein the switch further includes a scale mounted within the housing and viewable from outside the housing and indicators for the pressures required for moving the blade to its second position and for returning the blade to its first position.

17. The switch of claim 16 wherein the scale is a circular scale and the actuator includes an indicator which moves when the actuator is moved to provide a visual indication of the position of the cam surface.

18. The switch of claim 12 wherein the actuator also includes an indicator point which rotates when the actuator is rotated.

19. The switch of claim 15 wherein a rotatable annular scale having teeth about its circumference is mounted within the housing and a gear on the set screw enages the threads of the scale to rotate same as the pressure exerted by the nut on the main spring is adjusted.

* * * * *